US006932875B2

(12) United States Patent
Cheng et al.

(10) Patent No.: US 6,932,875 B2
(45) Date of Patent: Aug. 23, 2005

(54) GOLF CLUB HEAD AND METHOD FOR MANUFACTURING THE SAME

(76) Inventors: Bernard Cheng, 3 Fl., No. 67, Ming-Hsiang St., Hsin-Hsing Dist., Kaohsiung (TW); Hsiao-Kun Chen, No. 307, Chung-Cheng Rd., Chien-Chen Dist., Kaohsiung (TW); Jen-Hung Chiu, 6 Fl.-1, No. 535, Chien-Kao 3 Rd., San-Min Dist., Kaohsiung (TW)

( * ) Notice: Subject to any disclaimer, the term of this patent is extended or adjusted under 35 U.S.C. 154(b) by 207 days.

(21) Appl. No.: 10/644,880

(22) Filed: Aug. 21, 2003

(65) Prior Publication Data

US 2004/0034986 A1 Feb. 26, 2004

Related U.S. Application Data

(62) Division of application No. 09/818,836, filed on Mar. 28, 2001, now abandoned.

(51) Int. Cl.[7] ..... A63B 53/04; B23P 13/00

(52) U.S. Cl. ..... 148/522; 148/537; 29/418; 29/445; 29/459; 29/460; 29/527.4; 29/527.6; 473/347; 473/349

(58) Field of Search ..... 148/522, 537; 29/418, 445, 459, 460, 527.4, 527.6; 473/347, 349

(56) References Cited

U.S. PATENT DOCUMENTS

| | | | | |
|---|---|---|---|---|
| 1,575,364 A | | 3/1926 | Hodgkins | |
| 4,793,616 A | * | 12/1988 | Fernandez | 473/347 |
| 4,795,159 A | | 1/1989 | Nagamoto | |
| 4,824,116 A | | 4/1989 | Nagamoto et al. | |
| 4,869,507 A | | 9/1989 | Sahm | |
| 5,050,879 A | | 9/1991 | Sun et al. | |
| 5,207,428 A | | 5/1993 | Aizawa | |
| 5,378,295 A | * | 1/1995 | Yamashita et al. | 148/654 |
| 5,417,419 A | * | 5/1995 | Anderson et al. | 473/329 |
| 5,672,120 A | * | 9/1997 | Ramirez et al. | 473/347 |
| 5,776,011 A | | 7/1998 | Su et al. | |
| 6,126,556 A | | 10/2000 | Hsieh | |
| 6,171,204 B1 | | 1/2001 | Starry | |
| 6,648,774 B1 | * | 11/2003 | Lee | 473/342 |
| 6,880,222 B2 | * | 4/2005 | Matsunaga | 29/428 |
| 2003/0139226 A1 | * | 7/2003 | Cheng et al. | 473/334 |

* cited by examiner

*Primary Examiner*—George Wyszomierski
(74) *Attorney, Agent, or Firm*—Browdy and Neimark, PLLC

(57) ABSTRACT

A golf club head has a metal base, face and tubular neck and a carbon-fiber cover. The face extends up vertically from one edge of the base. The tubular neck is integrally connected to the base and the face. The cover is made of a carbon-fiber material and is securely attached to the base and the face. Because the carbon-fiber material is lighter than metal, the area of the face is enlarged. In addition, the shock absorbing effect of the golf head club is also improved.

9 Claims, 3 Drawing Sheets

GOLF CLUB HEAD AND METHOD FOR MANUFACTURING THE SAME

This application is a divisional application of application Ser. No. 09/818,836, filed on Mar. 28, 2001 now abandoned.

BACKGROUND OF THE INVENTION

1. Field of the Invention

The present invention relates to a golf club head and the method for forming the same, and more particularly to a golf club head with a large hitting face and good flexibility.

2. Description of Related Art

In general, one of two ways are usually used to manufacture a golf club head. One is to form the head with a cast mold process, and the other is to weld several parts together. However, because the conventional golf club head is always made of metal and the weight of the golf club head is standardized, the area of the face of the golf club head is limited. A new golfer easily misses the golf ball with a golf club having a conventional head. In addition, the shock absorbing effect of the conventional golf club head formed by combining several parts is easily reduced because of the welding process.

To overcome the shortcomings, the present invention tends to provide an improved golf club head to mitigate or obviate the aforementioned problems.

SUMMARY OF THE INVENTION

The main objective of the invention is to provide an improved golf club head having a face with a large area. The golf club head has a metal base, face and tubular neck and a carbon fiber cover. The face extends up vertically from one edge of the base. The tubular neck is integrally connected to the base and the face. The cover is securely attached to the base and the face. Because the carbon-fiber material is lighter than the metal, the area of the face is enlarged. In addition, a better shock absorbing effect is achieved due to the carbon-fiber cover.

Other objects, advantages and novel features of the invention will become more apparent from the following detailed description when taken in conjunction with the accompanying drawings.

DETAILED DESCRIPTION OF PREFERRED EMBODIMENT

Figure 1:
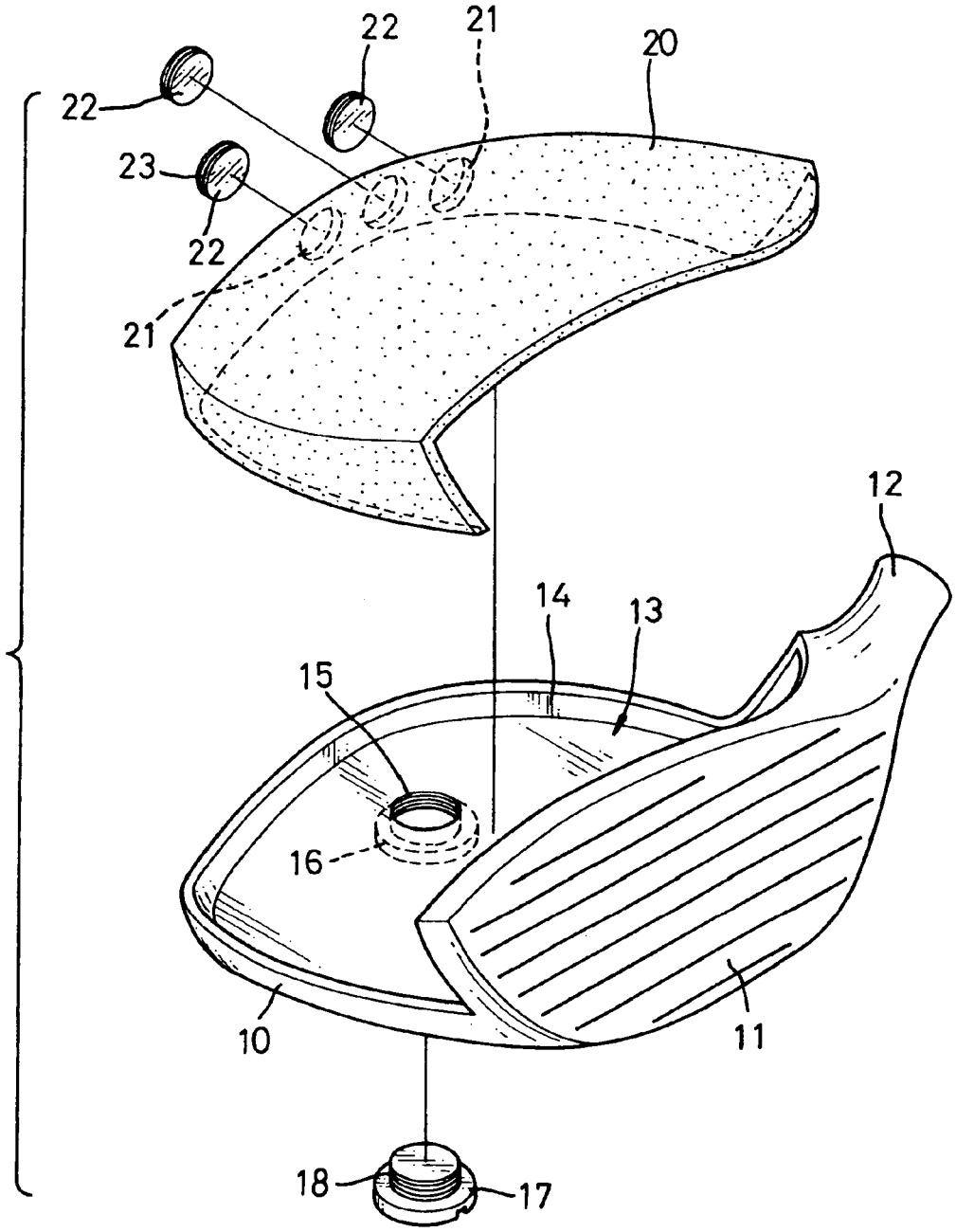
FIG. 1 is an exploded perspective view of a golf club head in accordance with the present invention.

With reference to FIG. 1, a golf club head in accordance with the present invention comprises a base (10), a face (11), a neck (12) and a cover (20). The base (10) is made of metal. A countersunk threaded hole (15) is defined in the base (10). A countersunk recess (16) is defined in the base (10) around the threaded hole (15). A threaded plug (18) with an enlarged head (17) is screwed into the threaded hole (15). Consequently, the threaded plug (18) is securely attached to the base (10) due to the engagement with the threaded hole (15).

The face (11) extends up vertically from one edge of the base (10). Grooves are defined on the outside of the face (11). The neck (12) is a tubular member and is integrally connected to the base (10) and the face (11). A lip (14) is formed around the edges of the base (10) to form a cavity (13) between the base (10), the lip (14) and the face (11).

The cover (20) is securely attached to the lip (14) and the face (11) to cover the cavity (13). At least one weighted plug (22) with an annular recess (23) in the outer edge is inlaid in the cover (20). A bore (21) is formed in the cover (20) to securely hold each weighted plug (22).

Figure 2:
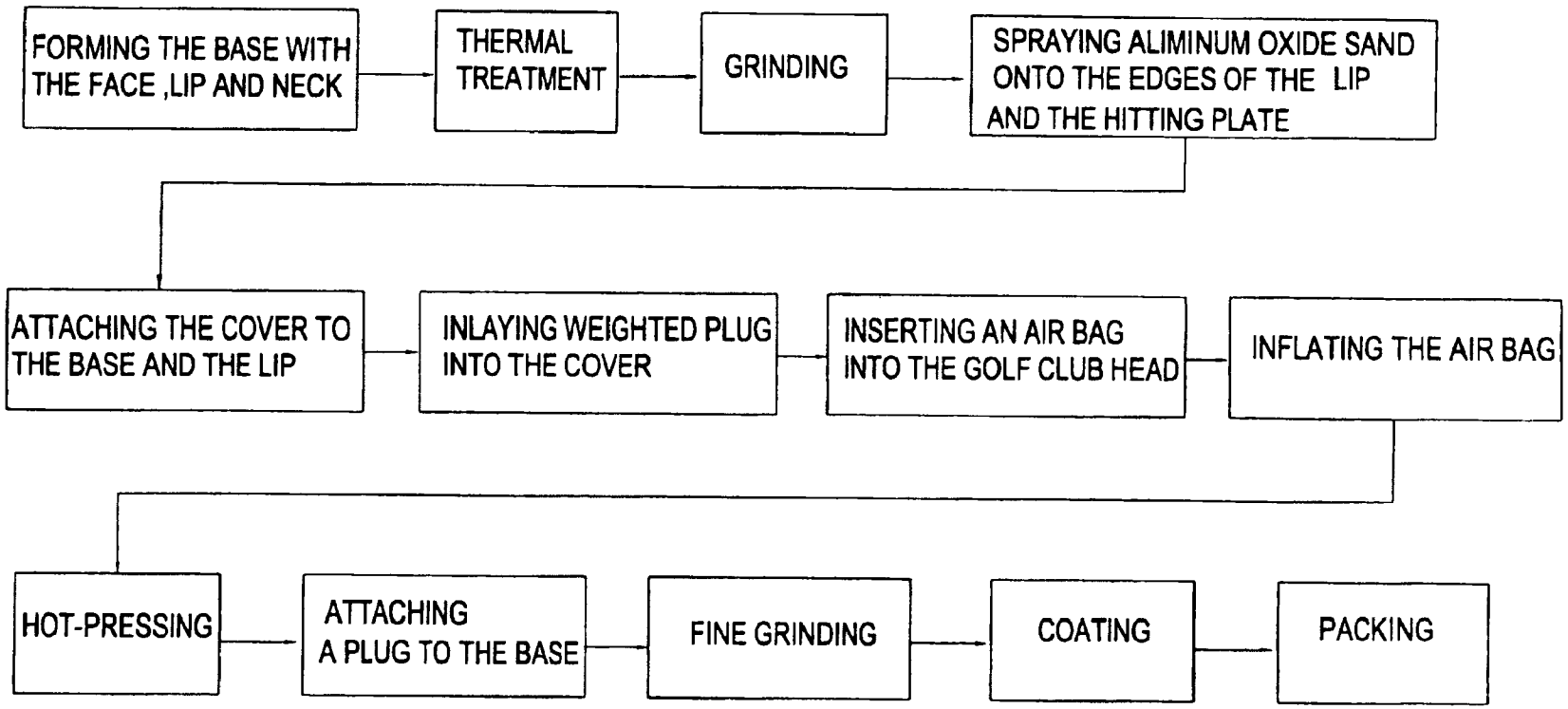
FIG. 2 is a block diagram of a method for manufacturing the golf club head in FIG. 1.
Figure 3:
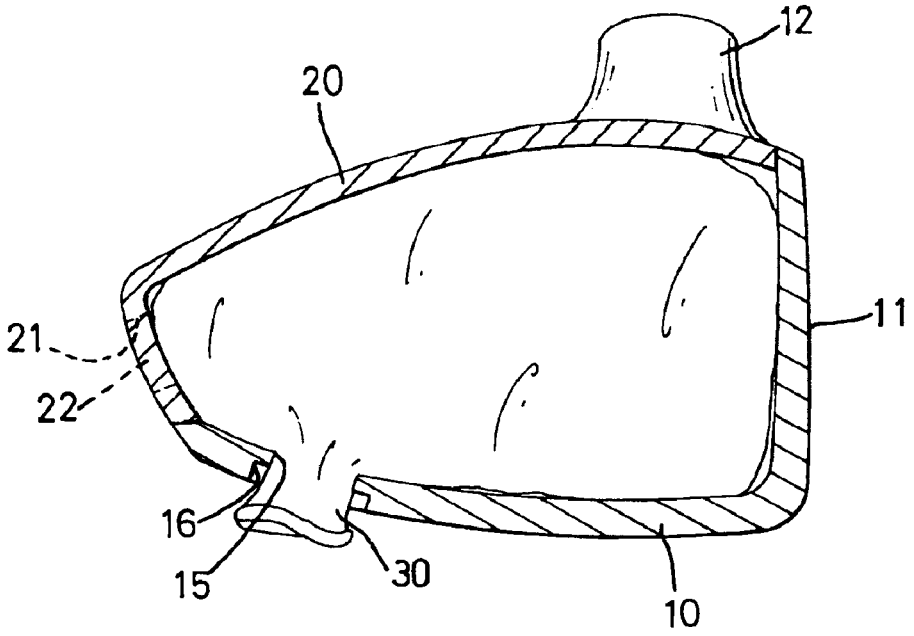
FIG. 3 is a side plan view in partial section of the golf club head in FIG. 1 with an air bag.
Figure 4:
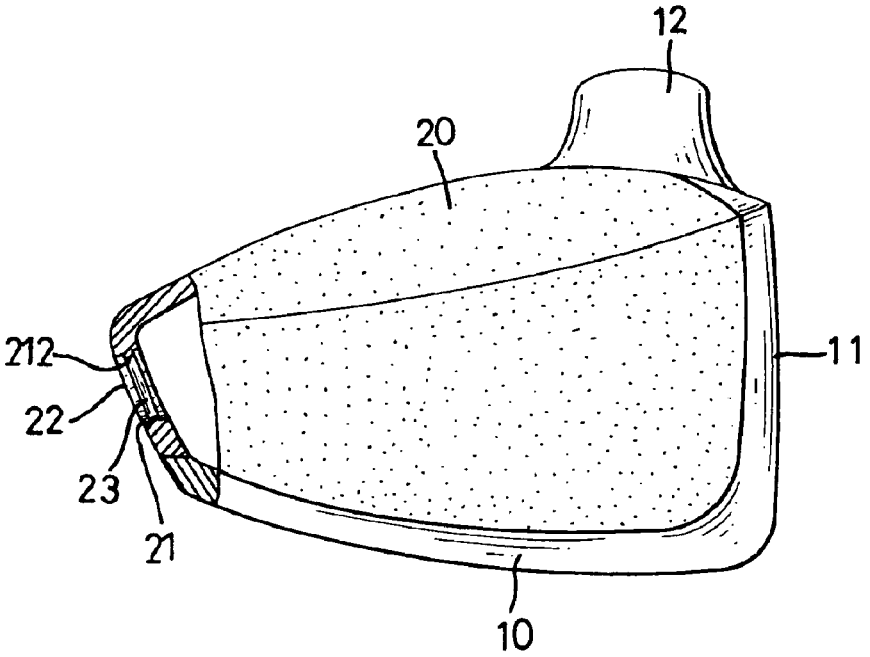
FIG. 4 is a side plan view in partial section of the golf club head in FIG. 1.

With reference to FIGS. 1 and 2, the process of manufacturing the golf club head comprises the following steps:

a. forming the base (10) and the face (11):

The base (10) with the lip (14) and the face (11) are cast molded. Then, the tubular neck (12) is formed with a forging process. The countersunk threaded hole (15) and the circular recess (16) are drilled in the base (10) and the threaded hole (15) tapped.

b. thermal treatment:

The body comprising the base (10), the lip (14), the face (11) and the neck (12) is thermally treated.

c. grinding:

The body is then ground to a desired shape and size.

d. spraying aluminum oxide sand onto the body:

By spraying the aluminum oxide sand onto the inner surface of the cavity (13) of the body and the edge around the cavity (13), the surface roughness of the body is increased.

e. attaching the cover (20) to the body:

The cover (20) formed with multiple carbon-fiber layers. Multiple bores (21) are defined in the cover (20). The cover (20) with bores (21) is attached to the body to cover the cavity (13).

f. inlaying the weighted plugs (22) into the cover (20):

A weighted plug (22) is put into each bore (21) in the cover (20).

g. inserting an air bag (30) into the body:

With reference to FIGS. 2 and 3, an air bag (30) is inserted into the cavity (14) through the threaded hole (15) in the base (10). The body with the air bag (30) is then put into a hot-pressing machine.

h. inflating the air bag (30) and hot pressing:

The air bag (30) is inflated and expands to abut the inner surface of the cover (20) and the body, such that the outer surface of the cover (20) will press against the entire inner face of the mold in the hot-pressing machine. During the hot-pressing mold process, the cover (20) will harden and form to a shape conforming to the shape of the hot-pressing mold. The cover (20) will be securely attached to the base (10) and the face (11). Because the edge of the base (10) and the face (11) was sprayed with the aluminum oxide sand, the attachment between the cover (20) and the body is enhanced. The weighted plugs (22) received in the bores (21) will be securely held into the cover (20) when the cover (20) hardens during the hot-pressing mold process. In addition, with reference to FIG. 4, a rib (212) will be automatically formed in each bore (21) during the hot-pressing mold process to engage the annular recess (23) in each weighted plug (22). The combination between each weighted plug (22) and the cover (20) is enhanced. In another embodiment, an annular rib is formed on an outer edge of each weighted plug (22), such that a recess engaging with the rib of each second block (22) will be defined in each bore (21) during the hot-pressing mold process.

i. attaching the threaded plug (18) to the base (10):

The air bag (30) is taken out of the body. The threaded plug (18) is screwed into the threaded hole (15) in the base (10) so that the head (17) is flush with the outer surface of the base (10). Consequently, the position of the center of gravity of the golf club head is adjustable based on the size and placement of the threaded plug (18) and weighted plugs (22).

j. fine grinding:

To increase the smooth of the surface of the golf club head, a fine grinding process is carried out.

k. coating: and

The outer surface of the golf club head is coated with lacquer to provide a protective coating on the head.

l. packing:

The golf club head is packed.

Accordingly, a golf club head with a carbon-fiber cover (20) is made. Because the weight of the carbon-fiber material is lighter than the metal, the weight of the golf club head is reduced. Consequently, a face (11) with a larger area can be formed on the golf club head that is the same weight as the conventional golf club head made of metal. The face is enlarged. The likelihood of completely missing the golf ball can be greatly reduced. In addition, because the elasticity of the carbon-fiber material is better than that of the metal material, the shock absorbing effect of the golf club head is improved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for manufacturing a golf club head, the method comprising the following steps:

a. integrally forming the body comprising a base and a face of metal in a casting molding process and forming a tubular neck of metal on the body by a forging process such that a cavity is defined between the base and the face;

b. spraying aluminum oxide sand onto an inner surface of the cavity and an outer edge around the cavity to increase a surface roughness of the body;

c. attaching a cover formed from multiple carbon-fiber layers to the body to cover the cavity; and d. attaching the cover to the body in a hot-pressing mold process such that a golf club head with a carbon-fiber cover is made.

2. The method for manufacturing a golf club head as claimed in claim 1 further comprising a step of a thermal treatment to the body after the body is formed.

3. The method for manufacturing a golf club head as claimed in claim 2 further comprising a step of grinding the body after the thermal treatment process to form the body to a desired shape and size.

4. The method for manufacturing a golf club head as claimed in claim 1, wherein at least one bore is defined in the cover to receive a weighted plug.

5. The method for manufacturing a golf club head as claimed in claim 1, wherein a countersunk through hole is defined in the base after the body is formed;

the through hole is tapped; and a plug with a threaded shaft is screwed into the threaded hole.

6. The method for manufacturing a golf club head as claimed in claim 5, wherein an air bag is inserted into the body with the cover through the threaded hole before the hot-pressing mold process is processed;

the air bag is inflated and expands to press against the inner surface of the cover and the body during the hot-pressing mold process to form the cover into a desired shape;

the air bag is taken out of the body after the cover has hardened; and the threaded plug is screwed into the threaded hole in the base.

7. The method for manufacturing a golf club head as claimed in claim 1 further comprising a step of fine grinding to increase the smooth of a surface of the golf club head.

8. The method for manufacturing a golf club head as claimed in claim 7 further comprising a step of applying a lacquer coating to an outer surface of the gold club head to provide a protective coating on the golf club head.

9. The method for manufacturing a golf club head as claimed in claim 1, wherein a lip is formed on an edge of the body to connect to the cover.

* * * * *